US005340421A

United States Patent [19]

Shea et al.

[11] Patent Number: 5,340,421

[45] Date of Patent: Aug. 23, 1994

[54] METHOD USING A CAM FOR FOLDING A SEAL REMOVAL TAB ON A COLLAPSIBLE TUBE

[75] Inventors: Patrick P. Shea, Mullica Hill, N.J.; Henry S. Darlington, Aston, Pa.

[73] Assignee: Teledyne Industries, Inc., Chester, Pa.

[21] Appl. No.: 128,180

[22] Filed: Nov. 18, 1993

[51] Int. Cl.[5] ..... B65B 7/28

[52] U.S. Cl. ..... 156/69; 156/221; 156/256; 156/262

[58] Field of Search ..... 215/232, 298, 303, 305; 220/258, 359; 53/478, 420, 133.3, 329.2, 329.3, 375.2, 374.7; 156/69, 223, 226, 227, 221, 256, 262

[56] References Cited

U.S. PATENT DOCUMENTS

| | | | |
|---|---|---|---|
| 2,309,093 | 1/1943 | Borden | 225/6 |
| 3,973,719 | 8/1976 | Johnson et al. | 220/258 |
| 4,754,890 | 7/1988 | Ullman et al. | 215/232 |
| 4,872,571 | 10/1989 | Crecelius et al. | 215/232 |
| 4,938,818 | 7/1990 | Dzedzej et al. | 156/69 |
| 5,121,845 | 6/1992 | Blanchard | 215/232 |
| 5,209,795 | 5/1993 | DeRosa et al. | 156/69 |

FOREIGN PATENT DOCUMENTS 2327161 5/1977 France .

*Primary Examiner*—Michael W. Ball
*Assistant Examiner*—Richard Crispino
*Attorney, Agent, or Firm*—Eugene Chovanes

[57] ABSTRACT

The present invention is for a method and cam for folding a tab for removing a seal that has been affixed to a collapsible tube in accordance with the method shown in U.S. Pat. No. 4,938,818. A laminate removal tab is cut integral with the seal when the seal is cut, as disclosed in U.S. Pat. No. 5,209,795 and then, in accordance with the present invention, bent back over the neck after the seal is welded to the tube mouth, by means of a cam. The tab is easily lifted and grasped by the fingers to pull the seal off the mouth.

1 Claim, 3 Drawing Sheets

METHOD USING A CAM FOR FOLDING A SEAL REMOVAL TAB ON A COLLAPSIBLE TUBE

BACKGROUND OF THE INVENTION

1. Field of the Invention

This invention relates generally to collapsible tubes used to contain and dispense fluids, and particularly to tubes having a seal of laminated material on the dispensing orifice of a prior art tube formed of a collapsible tube wall of laminate material welded to a plastic head portion.

Collapsible tubes are packages in tube form having a dispensing orifice at one end of a deformable tube. The tube is deformed and collapsed by squeezing so that the contents are forced out the orifice. Such tubes are used to contain toothpaste, pharmaceuticals, cosmetics, personal care products, artists' pigments, adhesives, sealants and caulking materials, greases and lubricants, foods and condiments, and many other products. Collapsible tubes generally have a screw cap closure.

2. Description of Related Art a. Prior Art Collapsible Tubes

Collapsible tubes are formed of (1) metal alone or (2) plastic alone, or (3) a combination of a rigid plastic head portion and a deformable laminate tube body portion.

b. Method of Making Prior Art Collapsible Tubes

Metal tubes are formed by impact extrusion from metal slugs in a die cavity wherein a ram forces the metal into the tube shape.

Plastic tubes of, for instance, polyethylene, are injection molded into the desired shapes.

Laminate tubes consist of at least two parts; namely, (1) a rigid pure plastic head portion and (2) a tube body formed of a laminate of layers of plastic and metal foil, adhesively held together. The tube body is joined, in a separate step, to the molded plastic head by, for instance, radio frequency welding.

The tubes are filled through an open bottom. The tubes are then closed at the bottom, generally by a fold.

c. Prior Art Seals on Collapsible Tubes

Prior art collapsible tubes, particularly those formed of metal, often have a seal across the dispensing orifice of the tube. Seals are generally used when the tube contains medicinal products. The seal is pierced and deformed before the contents are discharged.

d. Method of Forming Prior Art Seals

Prior art seals have been formed in different ways, depending upon the material from which the tube is made.

In the invention disclosed in U.S. Pat. No. 4,938,818 incorporated by reference herein, a seal of laminate material is cut, positioned on the head dispensing orifice and held thereto, and then heat-sealed by a hot press to the orifice before the head is welded to the laminate tube wall. When the tube wall is subsequently assembled and welded by radio frequency to the head, a special heat sink is positioned adjacent the seal to avoid damage to the seal.

The laminate material from which the seal is made is in web form and positioned across the heat dispensing orifice. A seal is die cut from the web right over the orifice, whereupon it is held securely thereto by a vacuum applied through the bottom of the head through the orifice. A heat press is applied to the seal over the orifice and the thermoplastic layer in the seal laminate, which is adjacent to the thermoplastic lip of the dispensing orifice, melts the thermoplastic at the contact interface, after which the press is removed. The weld then cools, hardens and fuses the seal to the outlet.

The head is then assembled with the tube wall, which has been preformed in prior art fashion. In forming the tube wall, a continuous web of material is formed into a continuous tube and then welded as by radio frequency along the longitudinal seam. The continuous tube so formed is then cut into lengths corresponding to the collapsible tube lengths.

The tube lengths are then assembled individually on a mandrel and brought into position adjacent the tube heads and welded thereto by radio frequency.

A special heat sink is placed adjacent the seal to absorb heat generated by the weld operation, so there is no heat buildup in the laminate seal, which contains a metal foil layer.

The seal of laminate material is pierced to gain access to the tube contents, as shown for instance by a cap having a point, as shown in FIG. 10 of the '818 patent.

e. The U.S. Pat. No. 5,209,795.

In the invention disclosed in U.S. Pat. No. 5,209,795, incorporated by reference herein, means are provided to remove, rather than pierce, the seal formed by the method disclosed in U.S. Pat. No. 4,938,818 referred to above. The seal is provided with an integral tab. The tab is positioned on the neck of the tube perpendicular, or normal, to the plane of the seal across the tube opening, and hugs the neck without adhering thereto. The tab is easily lifted from the neck and pulled to peel the seal from its weld to the neck. The weld is a relatively strong one so that the strength of the laminate is far greater than that of a pure thin metal foil, and is utilized to transmit the necessary force to separate the bond, or weld, between the seal and the orifice formed by the heat press when the seal was applied.

The tab is formed integrally when the seal is cut as disclosed in the '818 patent, and bent and positioned along the neck when the seal is welded to the plastic head, again the manner taught in the '818 patent.

SUMMARY OF THE PRESENT INVENTION

In the present invention, the seal removal tab as disclosed in the '795 patent referred to above, is bent back over the top of the seal, instead of along the neck, as in the '795 patent. The tab can be readily lifted away from the seal by a fingernail, for instance, and then firmly grasped between the thumb and forefinger. The seal can then be peeled from the tube neck by pulling over the tab.

The present invention discloses a cam having lifting and folding surfaces which act to bend the tab over and against the seal before the closure cap is screwed to the neck of the tube.

DESCRIPTION OF THE PREFERRED EMBODIMENT

Figure 1A:
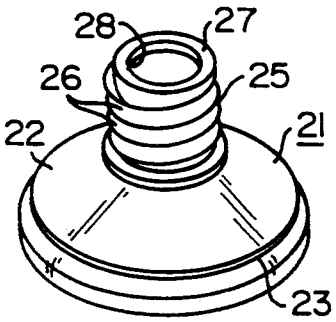
FIG. 1A is an isometric view of a typical thermoplastic molded head prior to having a circular laminated foil seal with a tab, welded to cover the discharge orifice.

A rigid injection molded thermoplastic head 21, as seen in FIG. 1A, has a downwardly, outwardly sloping shoulder 22. Shoulder 22 has at its outer circumference a recessed ridge 23. The head 21 is generally in the form of a concave disk and has at its center a neck 25 having integral screw threads 26 thereon. The neck 25 terminates at lip 27.

A dispensing orifice 28 extends through the neck 25. Head 21 is mass produced by injection molding, in one piece, in the well known prior art manner from a suitable thermoplastic such as polyethylene. The head 21 is subsequently joined to a tube body as set forth in the '818 patent and closed with a screw-on cap.

The seal 35 and tab 135 are formed in accordance with that method set forth in the earlier mentioned '818 and '795 patents. In such method, thermoplastic heads 21 are injection molded and moved continuously in a file, neck up. A continuous ribbon or web of laminate is moved over the heads 21 at the dispensing orifices 28. Circular seal 35, along with removal tab 135 is cut over dispensing orifice 28 on lips 27. The seal is held in position over the orifice on the lips by a vacuum applied underneath orifice 28. A heated platen is held against seal 35 momentarily to force the laminate, of which seal 35 is formed, to the lips 27 of plastic head 21.

Figure 1B:
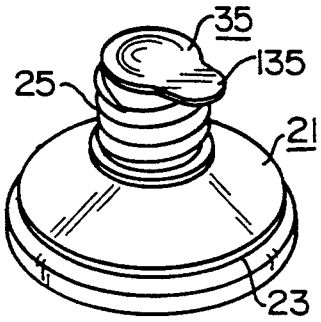
FIG. 1B is an isometric view similar to FIG. 1A but showing a circular laminate seal with a tab welded to the head to close the discharge orifice.
Figure 1C:
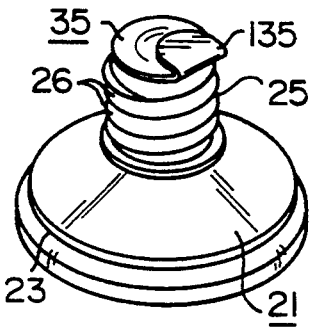
FIG. 1C is an isometric view similar to FIG. 1B but showing the tab on the circular foil seal having been folded upward and inward to be adjacent the upper surface of the circular foil seal, all in accordance with the invention.
Figure 2:
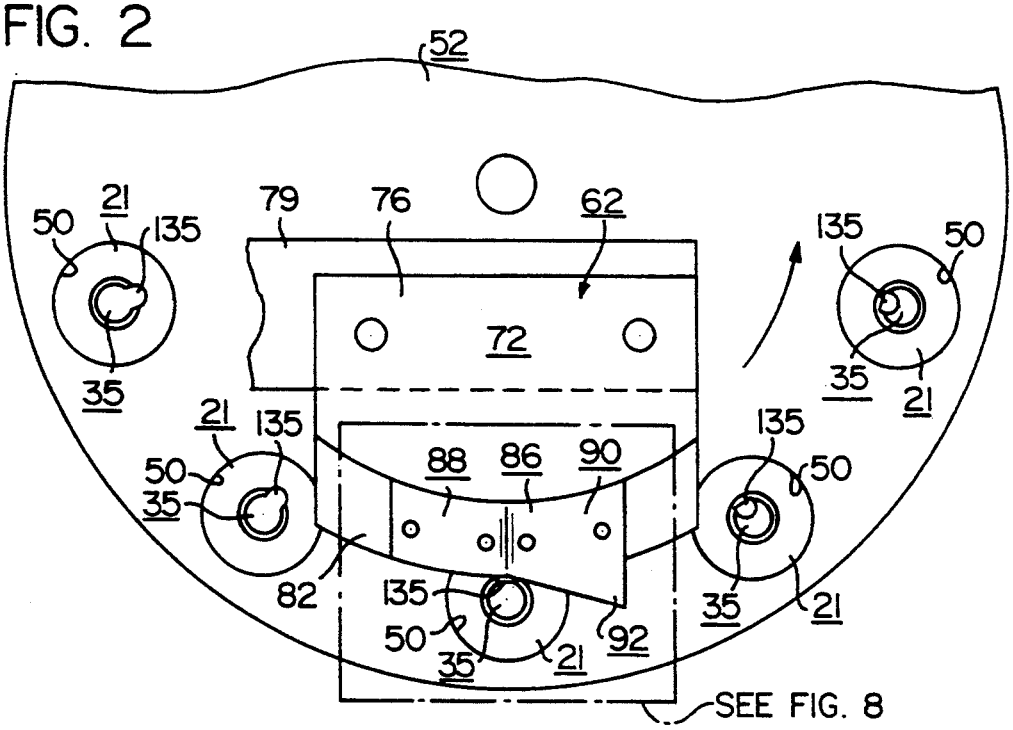
FIG. 2 is a semi-schematic, fragmentary plan view illustrating the method by which the tabs of the circular foil seals are folded into the desired position as shown in FIG. 1C by means of rotating the heads having welded circular laminated seals such as shown in FIG. 1B in a fixed circular path that brings the tabs of the seals into inter-engagement with a fixed block having a single integrated dual plane cam surface, all in accordance with the invention.

The method and cam of the present invention are concerned with folding the tab 135 from the position shown in FIG. 1B to that shown in FIG. 1C; namely, back over the seal. A cap can be then screwed on a fully completed tube. The consumer, when initially using the tube, after unscrewing the cap, lifts the tab with a fingernail or other sharp instrument, whereupon the tab 135 can be grasped and pulled to peel the seal away from the tube neck.

Figure 3:
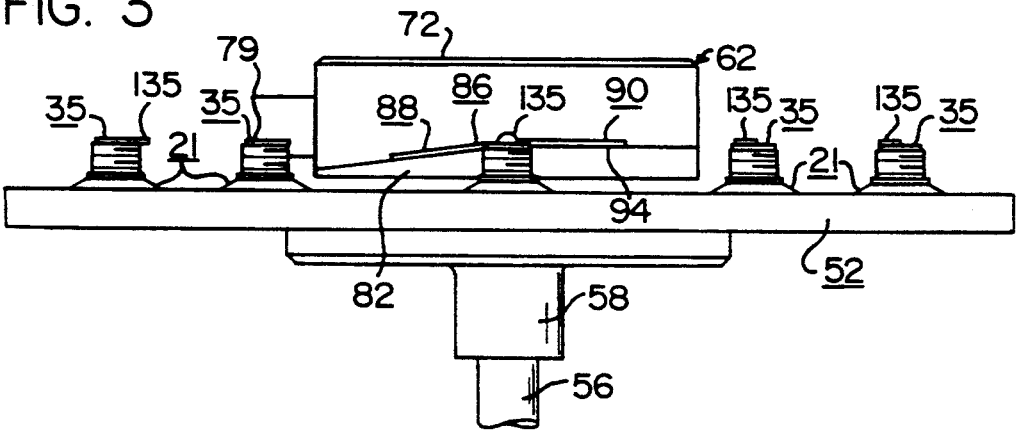
FIG. 3 is a front elevational view of the apparatus described in FIG. 1 showing a pocket wheel containing heads having circular seals with tabs as shown in FIG. 1B on the left-hand side of the drawing and passing in a fixed horizontal plane, the fixed block having a single integrated dual plane cam surface as it moves to the right of the drawing.

In the present invention, head 21, as seen in FIG. 1B, with tab 135 continuing to extend in the same plane as seal 35 after the seal 35 is welded to head 21, is deposited into a pocket 50 in pocket wheel 52. A drive rotating vertical shaft 56, having journalled thereon a mounting disk with hub 58, supports and rotates the wheel 52, having a series of circumferentially equally spaced pockets 50. The heads 21 extend above the top surface of rotating pocket wheel 52 as seen best in FIG. 3.

A cam 62 is fixed above the rotating pocket wheel 52. The cam 62 is in the form of a fixed block having a single integrated dual plane cam surface.

Cam assembly 62, as seen in FIGS. 4 through 7, inclusive, has a base portion 72 having a mounting arm 76. Securing bolt holes 78 permit the arm 76 to be bolted to a suitably located bracket 79 extending over the rotating pocket wheel 52. A downwardly stepped portion 80 of cam 62 has integrally extending therefrom a cam lift and shoulder portion 82. A single integrated dual plane cam surface plate 86, suitably of plastic, is bolted at 89 to the lift and shoulder portion 82 of cam 62.

Cam surface plate 86 has a first and second surface 88 and 90. The first surface 88 on the top and edge of plate 86 rises at an angle $\beta$ at approximately 7° to the horizontal and extends circumferentially relative to the rotating pocket wheel which permits the tab 135 to be lifted from the position of FIG. 9A to the position shown in FIG. 9B.

Figure 4:
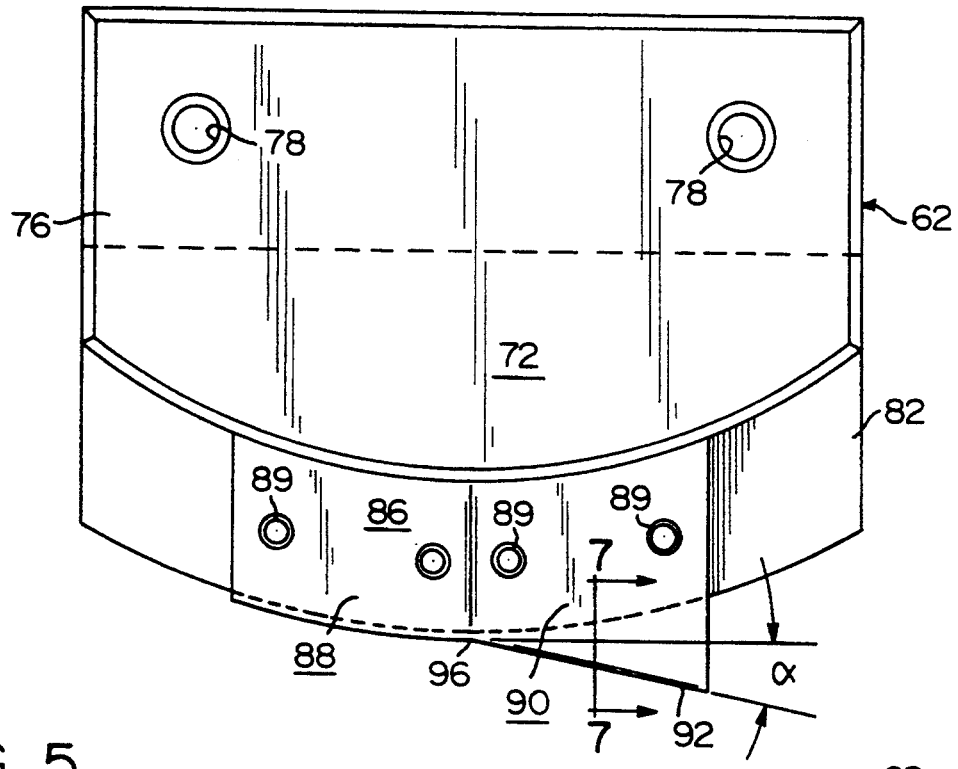
FIG. 4 is an enlarged plan view of the block having a single integrated dual plane cam surface.
Figure 5:
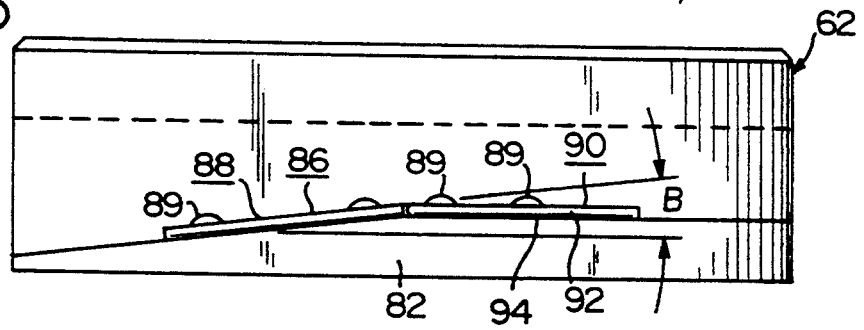
FIG. 5 is a front elevational view of the block and single integrated dual plane cam surface shown in FIG. 4.
Figure 6:
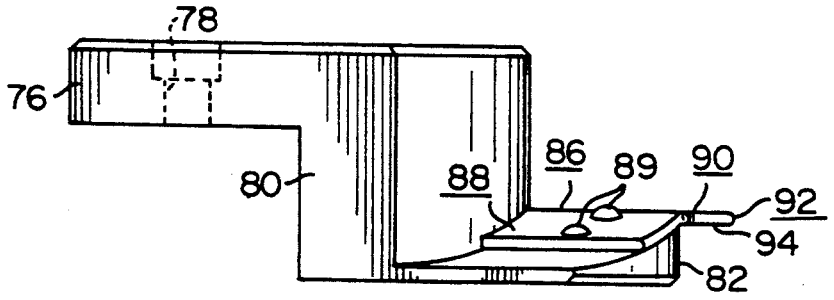
FIG. 6 is a left-hand side elevational view of FIG. 5.
Figure 7:
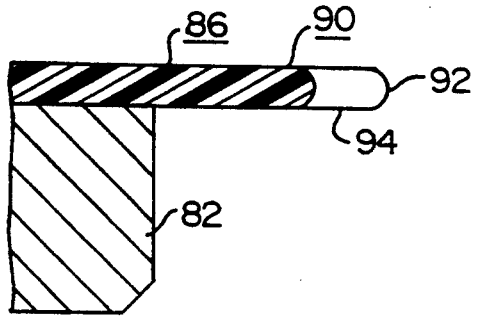
FIG. 7 is an enlarged fragmentary sectional view taken on the line 7,7 of FIG. 4.

The second cam surface 90 on the edge 92 and bottom of plate 86 extends in the horizontal plane as seen particularly in FIGS. 4 and 7. The edge 92 forms an optimum angle $\alpha$ of approximately 11.5° with a tangent to the path of rotation of the pocket wheel at the beginning of contact with tab 135 at location 96.

Figure 9A:
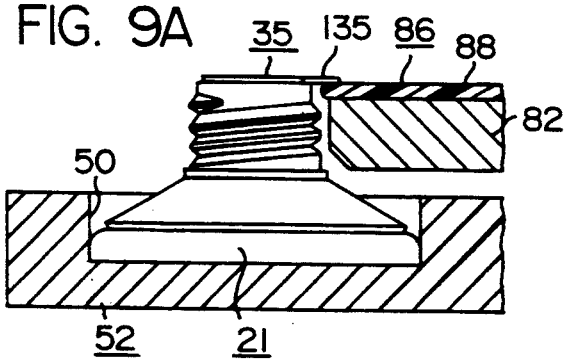
FIGS. 9A, 9B and 9C are sequential fragmentary sectional elevational views taken on the lines 9A,9A; 9B,9B and 9C,9C, illustrating the sequential folding of the circular foil seal tab to the desired position 25 shown in FIG. 1C.
Figure 9B:
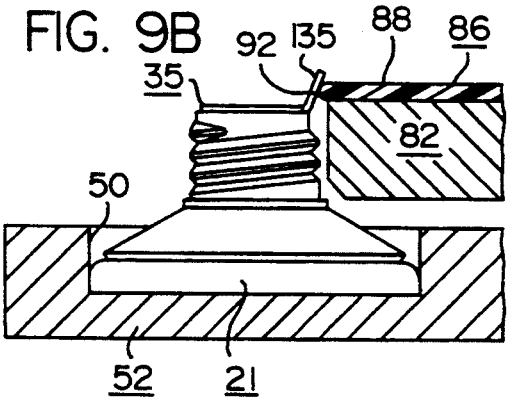
Figure 9C:
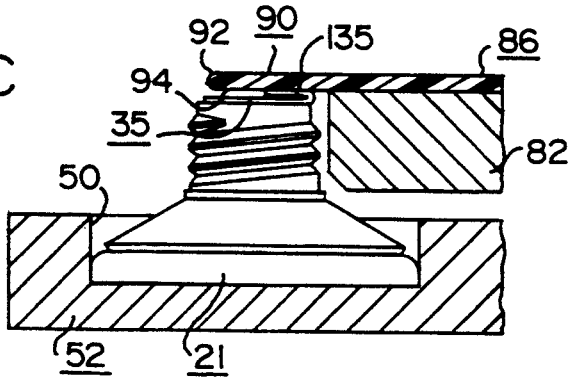

This second cam surface 90 extends for a circumferential distance equal to a relative rotation of the pocket wheel what causes the tab 135 to be folded from a vertical position as seen in FIG. 9B to a flat horizontal position against the seal 35 as seen in FIG. 9C.

The lower surface of cam plate surface 92 extends horizontally just above the seal 35 with enough clearance to pass over the seal 35 with the tab 135 in completely folded position.

Figure 8:
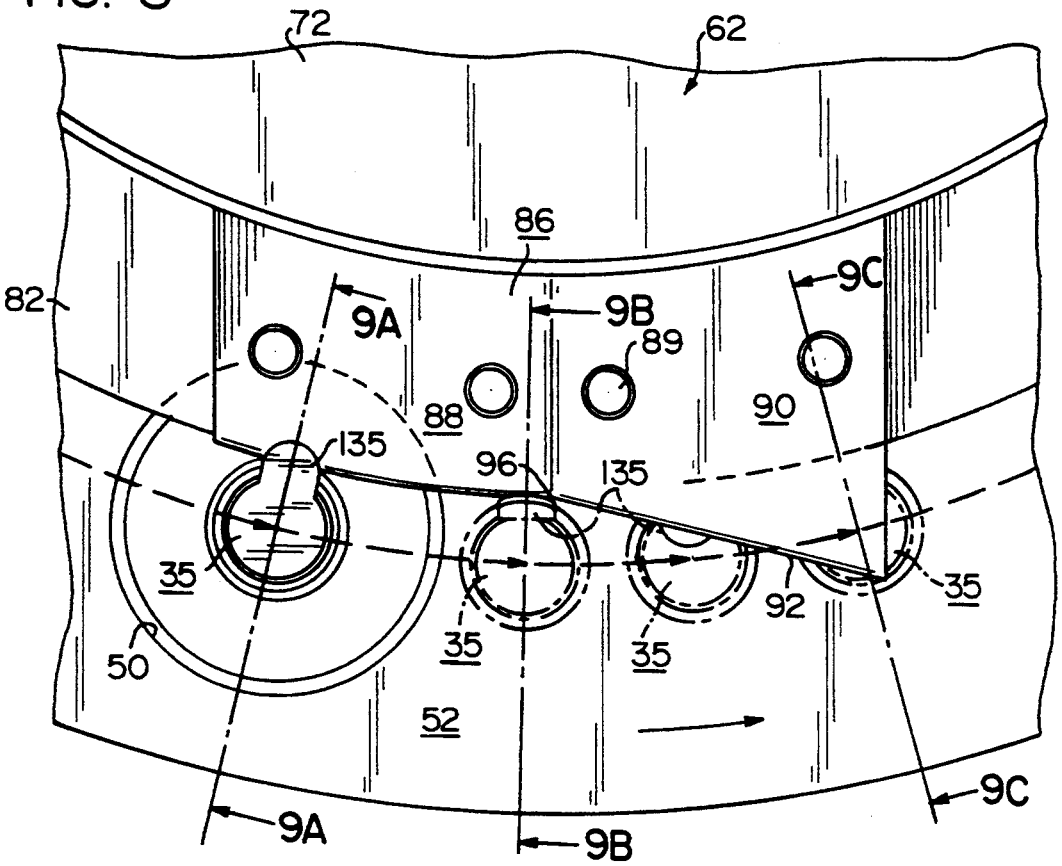
FIG. 8 is an enlarged fragmentary plan view of the details contained within the dot-and-dash rectangle shown in FIG. 2 and designated FIG. 8, showing the sequential folding of the circular foil seal from the instant of contact with the tab-lifting portion of the single integrated dual plane cam surface, shown in full line, to the completed folded tab position shown in dot-and-dash line, as the circular foil seal passes under the angularly and horizontally disposed portion of the cam.

In operation, as seen particularly in FIGS. 8 through 9C inclusive, surface 88 of plate 86 of cam 62 comes in contact with tab 135 underneath the tab 135. This is seen in elevation in FIG. 9A. As the wheel continues to rotate in a counterclockwise fashion as seen in FIG. 8, surface 88 lifts the tab 135 into a vertical position upwardly, as seen in FIG. 9B.

As pocket wheel 52 continues to rotate, surface 92 on the edge of plate 86 of the cam 62 begins to fold the tab 135 back over the seal 35 beginning at a point in the rotation just beyond the point 96 depicted in FIG. 9B.

The cam surface 94 on the bottom of plate 86 then comes into contact with tab 135, and upon completion of the rotational contact with cam 62, tab 135 is folded back on seal 35 as seen in FIGS. 1C and 9C.

Pocket wheel 52 continues to rotate and head 21 with folded tab 135 is suitably removed from its pocket 50 and positioned within the system as set forth in the '818 and '795 patents to complete the tube construction.

We claim:

1. The method of forming a tab on a seal of a laminate of plastic and metal across the dispensing orifice of a collapsible tube having (a) a separately made rigid plastic head portion with a neck and a dispensing opening therein, and (b) a separately made tube body of a laminate of plastic and metal foil, the head and tube body being welded together with radio frequency waves;

wherein the seal was formed by (1) applying the seal to the dispensing orifice of the head before the head is welded to the tube body by (a) moving a file of heads past a first station;

(b) stopping each head intermittently at the first station;

(c) continuously applying a vacuum to the head and dispensing orifice from below the head at the first station;

(d) passing a web of laminate over the head adjacent the dispensing orifice at the first station;

(e) cutting a seal from the web of laminate adjacent the dispensing orifice;

(f) keeping the seal of laminate positioned on the head over the dispensing orifice by means of the vacuum;

(g) applying a hot press to the seal, by reciprocating upward and downward motion, to fuse the seal to the head; and (h) terminating the vacuum below the head to the dispensing orifice, and (2) inserting a heat sink adjacent the seal during the welding by radio frequency waves of the head to the tube body, whereby any buildup of heat in the laminate seal is dissipated away from the seal to prevent damage to the seal;

the improvement comprising:

1. cutting a tab that is integral with and extends radially beyond the seal, when cutting the seal from the web of laminate adjacent the dispensing orifice, as set forth in step (e) above; and 2. bending said radially extending tab back and over against the top of the seal so that it extends substantially parallel to the plane of the seal, wherein the bending (a) occurs after the seal is fused to the head, and (b) is accomplished by relative motion between a pocket wheel and a cam having a first and second cam surface, the first surface lifting the tab to a vertically upward position from the seal, and the second cam surface bending the tab to a horizontal flat position over and against the seal.

* * * * *